US005642882A

United States Patent [19]

Guerzini

[11] Patent Number: 5,642,882

[45] Date of Patent: Jul. 1, 1997

[54] BUTT CAP FOR SPORTS RACQUET

[75] Inventor: Michael F. Guerzini, Bordentown, N.J.

[73] Assignee: Prince Sports Group, Inc., Bordentown, N.J.

[21] Appl. No.: 615,672

[22] Filed: Mar. 13, 1996

[51] Int. Cl.[6] ..... A63B 49/08

[52] U.S. Cl. ..... 473/549; 473/300

[58] Field of Search ..... 273/73 R, 73 J, 273/75; 473/298, 300, 301, 302, 303

[56] References Cited

U.S. PATENT DOCUMENTS

| | | | |
|---|---|---|---|
| 399,340 | 3/1889 | Morgan | 273/75 |
| 4,195,837 | 4/1980 | Poulin | 273/298 |
| 4,984,793 | 1/1991 | Chen | 273/75 |
| 5,000,452 | 3/1991 | Kuebler | 473/301 X |
| 5,244,209 | 9/1993 | Benzel | 273/298 X |
| 5,333,854 | 8/1994 | Woollard et al. | 273/73 J X |
| 5,425,534 | 6/1995 | Chen | 273/73 J |

FOREIGN PATENT DOCUMENTS

| | | | |
|---|---|---|---|
| 2925629 | 1/1981 | Germany | 273/75 |
| 655663 | 5/1986 | Switzerland | 273/75 |

*Primary Examiner*—William E. Stoll
*Attorney, Agent, or Firm*—White & Case

[57] ABSTRACT

A sliding trap door butt cap for use on a sports racquet such as a tennis racquet includes a cap base and a removable cap plate. The bottom of the cap base has a rectangular guide opening including a pair of opposed keyways, and a ramp portion extending from the keyway on the inwardly facing surface of the cap base. A cap plate has a pair of L-shaped legs extending from the upper surface. The legs are inserted into the respective keyways, and then slid along the ramp portions to draw the cap plate against the cap base. Preferably, the base has an outer border that defines a socket for receiving the cap plate, and the cap plate further includes a tab that engages the guide opening when the cap plate is in position over the socket, so as to lock the cap plate.

5 Claims, 4 Drawing Sheets

BUTT CAP FOR SPORTS RACQUET

FIELD OF INVENTION

The present invention relates to sports racquets in which the lower end of the handle has a butt cap, and has particular application to tennis racquets.

BACKGROUND OF THE INVENTION

Composite tennis racquet frames were traditionally made with a foam core, which acted to quiet the racquet and to prevent rattles due to debris that remained inside the hollow chamber of the racquet frame after drilling.

In recent years, composite tennis racquets have increasingly been made without foam cores, in order to reduce the weight of the racquet. Racquet companies have introduced butt caps with an end plate that can be removed by the purchaser, in order to shake out excessive drilling debris. For example, Prince Sports Group markets tennis racquets having a trap door butt cap, in which a removable, octagonal shape butt cap plate fits into an octagonal seat in the butt cap base. The plate can be removed using a key and, after debris is removed, refitted into the octagonal seat. A pair of latch members, formed on the plate, snap into a rectangular cutout formed in the butt cap base to hold the plate securely in place.

SUMMARY OF THE INVENTION

The present invention is an improved trap door butt cap, which includes a butt cap base and a removable butt cap plate, but in which the plate is secured to the butt cap base by a sliding/locking engagement, in order to provide a more secure attachment to the cap base, and also to allow a full cosmetic presentation of a company logo on the trap door plate.

More particularly, a sliding trap door butt cap according to the invention includes a cap base and a removable cap plate. The cap base has at least one guide opening forming a first guide surface, a keyway, and a guide ramp portion on the inner surface, having its smaller end adjacent the keyway and increasing in height along said first guide surface away from said keyway. The cap plate has at least one engagement member on said upper surface, preferably in the form of an L-shape leg, having a first portion extending from the upper surface substantially perpendicular thereto and a second portion extending at an angle relative to the first portion. The second portion is sized so as to pass through said keyway, and the first portion is sized so as to moveable within the guide opening along the first guide surface. Also, the second portion is positioned so as to engage the ramp surface when the first portion is moved along said first guide surface, so as to draw the cap plate toward the cap base.

Preferably, the cap plate further includes means, e.g., a tab, on its upper surface for engaging the guide opening after the plate has moved a predetermined distance along the guide opening, for locking the plate relative to said base.

In the most preferred embodiment, the guide opening is rectangular, with opposed, parallel surfaces forming first and second guide surfaces, a pair of opposed keyways and a ramp guide portion associated with each keyway and guide surface. A pair of L-shape legs are spaced from one another so that each engages a respective keyway, guide surface, and ramp guide portion.

Preferably, the cap base bottom is octagonal in shape, and includes a border forming a socket for receiving the cap plate within. The locking tab on the cap plate (the cap plate also being octagonal in shape) is positioned to snap into said guide opening when the plate has been moved along said ramp sufficiently so as to be located over the socket, so that the tab engages the base, and the cap plate seats within the socket, simultaneously.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
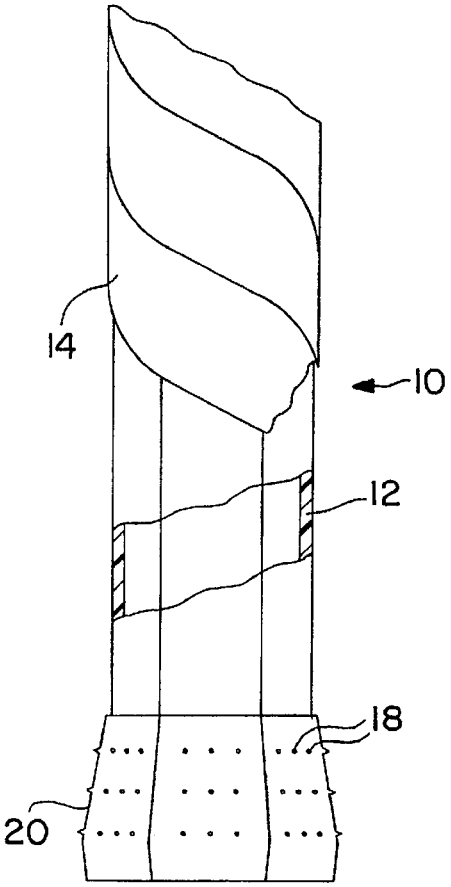
FIG. 1 is a side view of a tennis racquet handle, in which the grip is partially broken away to illustrate a butt cap according to the invention.
Figure 5:
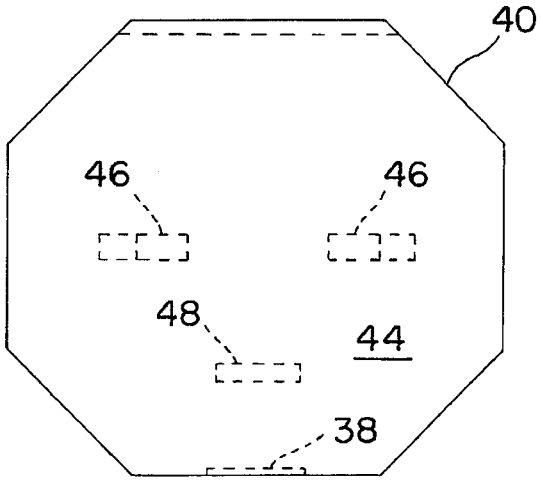
FIGS. 5 and 6 are bottom and side views, respectively, of a butt cap plate to be used with the butt cap base, shown on the same scale as FIGS. 2–4.

FIG. 1 illustrates a tennis racquet handle 10 broken away in sections for illustration. The handle 10 includes a hollow frame portion 12, which is formed of composite material, and is wrapped in a conventional manner by a grip 14. A butt cap 20 is positioned over the lower end of the handle frame 12. Normally, the grip is wrapped over the butt cap 20 and handle frame 12, starting at the butt cap end, and for this purpose the butt cap 20 may be provided with a plurality of grip-holding nubs 18.

Figure 2:
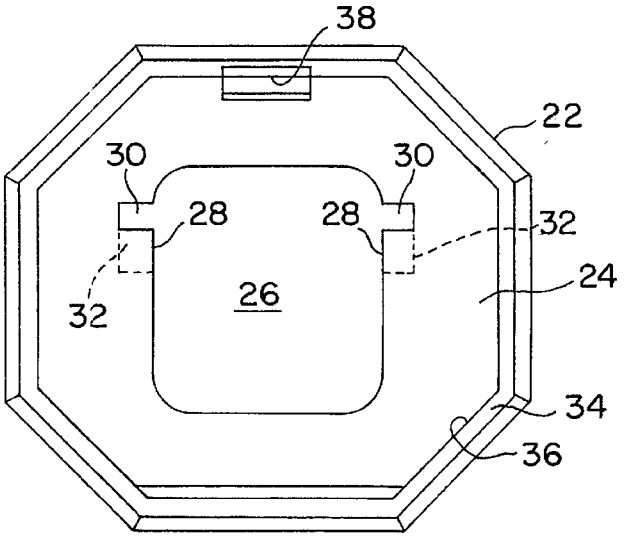
FIG. 2 is a bottom view of the base of the butt cap shown in FIG. 1, i.e., looking in a direction toward the handle, shown on an enlarged scale.
Figure 3:
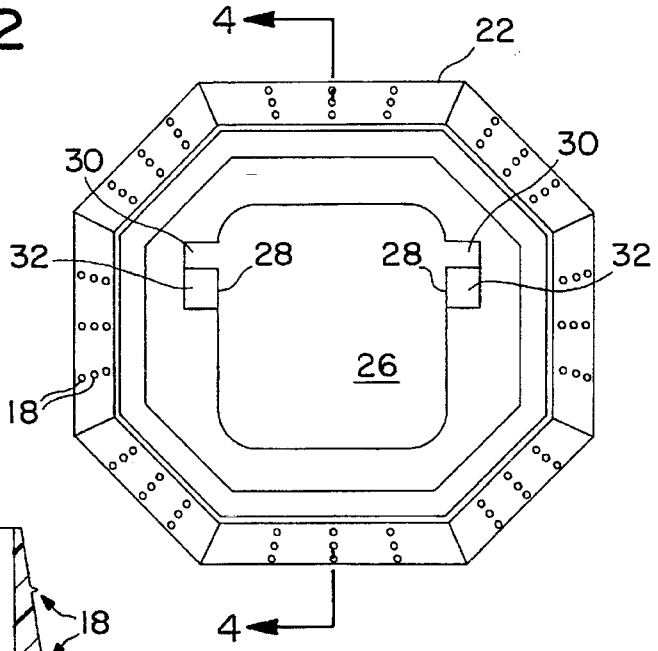
FIG. 3 is a top view of the butt cap base of FIG. 2.
Figure 4:
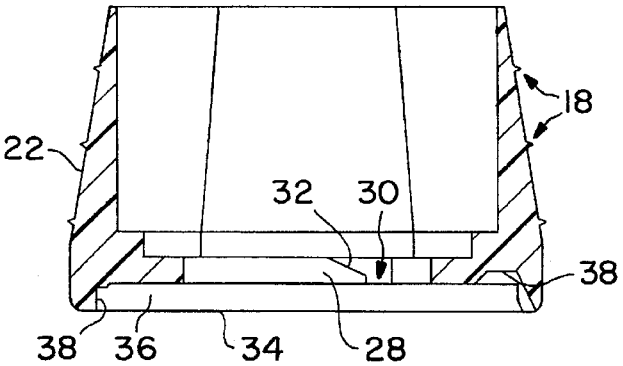
FIG. 4 is a cross-sectional view of the butt cap base, taken through lines 4—4 of FIG. 3.
Figure 7:
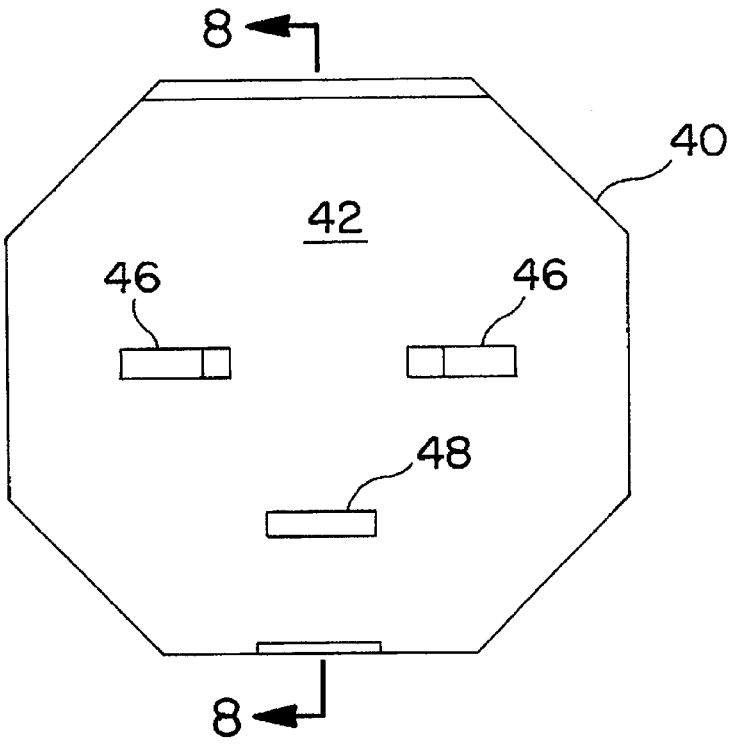
FIG. 7 is a top view of the butt cap plate.
Figure 8:
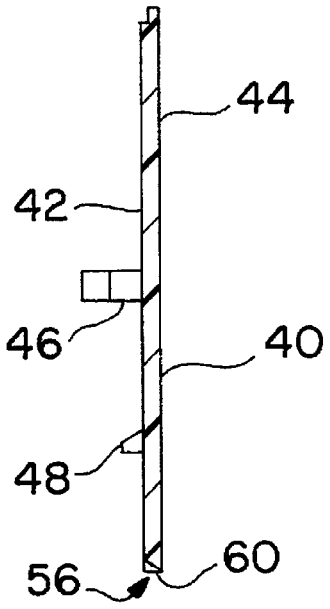
FIG. 8 is a cross-sectional view of the butt cap plate, taken through lines 8—8 of FIG. 7.

The butt cap 20 includes a base 22 and a cap plate 40, preferably made of plastic. Referring to FIGS. 2–4, the bottom outer surface 24 of the base 22 includes a generally rectangular opening 26 having a pair of opposed, parallel guide surfaces 28, and a pair of opposed keyways 30. A ramp guide portion 32 extends adjacent each guide surface 28. The ramp guide portion 32 has its smaller end adjacent the keyway 30 and increases in height along the first guide surface 28 away from the keyway, as shown in FIG. 4.

The bottom of the base also includes a thin, octagonal border 34, forming an octagonal shape socket 36 for receiving a cap plate, described below.

Figure 6:
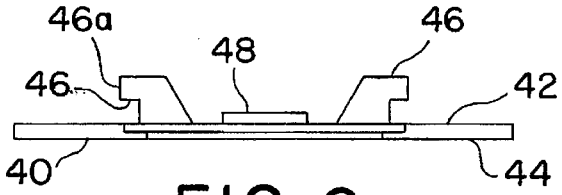

FIGS. 5–8 show an exemplary embodiment of a cap plate 40. The cap plate 40 is octagonal in shape, and includes a top surface 42 and a bottom surface 44, the bottom surface 44 facing outwardly when the cap plate 40 is secured to the cap base 20 (see FIG. 12). A pair of L-shape legs 46 extend from the top surface 42. As best shown in FIG. 6, the legs 46 face in opposite directions and include a first portion that extends generally perpendicular to the top surface 42, and a second portion 46*a* that extends generally perpendicular to the first portion. An engagement tab 48 is also formed on the top surface 42.

Figure 9:
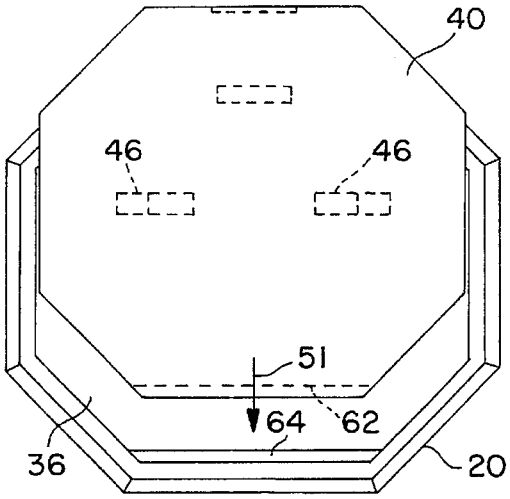
FIGS. 9–10 are bottom views illustrating a two-step insertion of the butt cap plate into the butt cap base.
Figure 10:
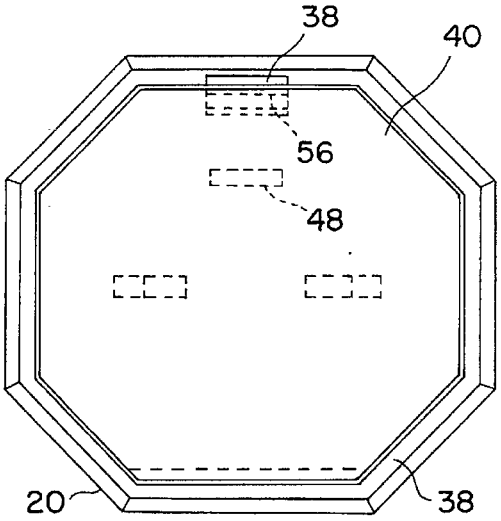
Figure 11:
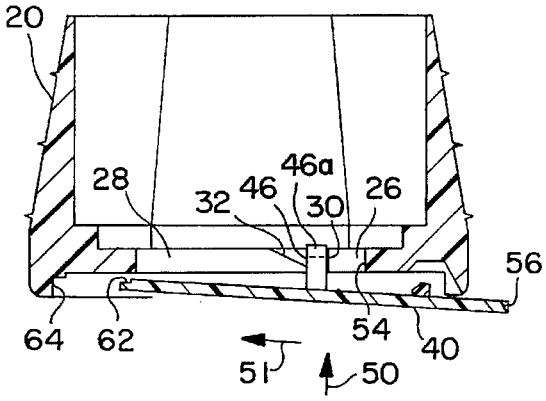
FIGS. 11–12 are cross-sectional views, corresponding to FIGS. 4 and 8, illustrating the two-step insertion process.

The assembly of the two components is illustrated in FIGS. 9–12. As shown in FIGS. 9 and 11, the cap plate 40 is placed over the socket end 36 of the cap base 20, and the second portion 46*a* of the legs is inserted through the two keyways 30, as shown by arrow 50 in FIG. 11. The cap plate 40 is then pushed along the guide surfaces 28, in the direction of arrow 51, such that the ramp portion 32 engages the second portion 46*a* of the legs 46 and pulls the cap plate 40 toward the base 20.

Figure 12:
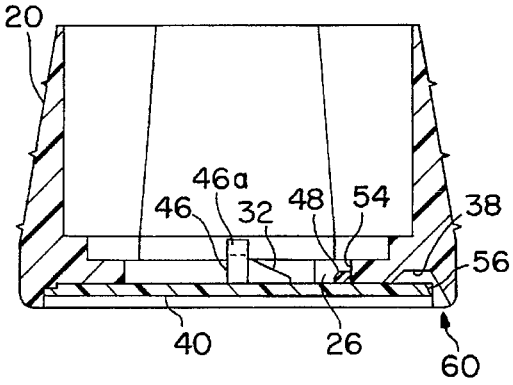

When the second portion 46*a* reaches the end of the ramp portion 32, the cap plate 40 will be positioned over the octagonal socket 36 of the base 20, and the engagement tab 48 will have just reached the rear edge 54 of the opening 26. Thus, the cap plate 40 can be snapped down so that the tab 48 engages the surface 54 of the opening, while at the same time the plate 40 seats in the socket 36, as shown in FIGS. 10 and 12.

As also shown, the border 38 of the base 20, and the adjoining edge of the cap plate 40, can include cutouts 38, 56. The cutout 38 in the base and the cutout 56 in the cap plate 40 define a slot 60 (see FIG. 12) that allows a screwdriver or other instrument to be inserted under the edge of the plate 40, so as to pry the edge of the cap plate 40 free of the base 20. The cap plate can then be removed from the base either by using the screwdriver to pry the legs free of the guides 28, or by sliding the legs 46 along ramp 32, until reaching the keyways 30.

As also shown, the edges of the plate and base may also include cooperating cutouts 62, 64 for a more secure fit.

Due to the fact that the engagement means on the cap plate 40 is located completely on the inner surface, the outer surface 44 is completely free for aesthetic use, such as bearing a logo. Moreover, because the outer surface 44 is not engaged during the removal process, it is possible to apply a decorative, e.g., glossy, surface finish or to adhere an outer plate (not shown) over the cap plate, containing such a surface.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

I claim:

1. A sliding trap door butt cap for use on a sports racquet such as a tennis racquet, said cap comprising:

a cap base having a bottom with an outer surface and an inner surface, with at least one guide opening in said bottom forming a first guide surface, said opening including a keyway and a guide ramp portion on said inner surface, having its smaller end adjacent said keyway and increasing in height along said first guide surface away from said keyway; and a cap plate having lower and upper surfaces, at least one engagement member on said upper surface, said engagement member having a first portion extending from said upper surface substantially perpendicular thereto and a second portion extending at an angle relative to said first portion, wherein said second portion is sized so as to pass through said keyway, wherein said first portion is sized so as to be moveable within said guide opening along said first guide surface, and wherein said second portion is positioned so as to engage said ramp surface when said first portion is moved along said first guide surface, so as to draw the cap plate toward the cap base.

2. A sliding trap door butt cap according to claim 1, wherein said cap plate further includes means on said upper surface for engaging said guide opening after said plate has moved a predetermined distance along said guide opening, for locking said plate relative to said base.

3. A sliding trap door butt cap according to claim 2, wherein said at least one guide opening has opposed, parallel surfaces forming first and second guide surfaces, a pair of opposed keyways and ramp guide portions, one said pair associated with each guide surface; and wherein said at least one engagement member comprises a pair of L-shape legs spaced from one another so that each engages a respective keyway, guide surface, and ramp guide portion.

4. A sliding trap door butt cap according to claim 2, wherein said cap base bottom face is octagonal in shape, and includes a border forming a socket for receiving said cap plate within, wherein said cap plate is octagonal in shape, and wherein the means for locking said plate is a tab positioned to snap into said guide opening when said plate has been moved along said ramp sufficiently so as to be located over said socket, so that said tab engages said base, and said cap plate seats within said socket, simultaneously.

5. A sliding trap door butt cap according to claim 4, wherein said at least one guide opening has opposed, parallel surfaces forming first and second guide surfaces, a pair of opposed keyways and ramp guide portions, one said pair associated with each guide surface; and wherein said at least one engagement member comprises a pair of L-shape legs spaced from one another so that each engages a respective keyway, guide surface, and ramp guide portion.

* * * * *